US007037139B1

(12) United States Patent
Stefaniu et al.

(10) Patent No.: US 7,037,139 B1
(45) Date of Patent: May 2, 2006

(54) WIRETRAP ELECTRICAL CONNECTOR AND ASSEMBLY WITH STRAIN RELIEF PLATE

(75) Inventors: Valentin M. Stefaniu, Lake Zurich, IL (US); John T. Scheitz, Barrington, IL (US); Charles Kozel, McHenry, IL (US)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 11/069,107

(22) Filed: Feb. 28, 2005

(51) Int. Cl.
*H01R 17/00* (2006.01)

(52) U.S. Cl. ..... 439/660

(58) Field of Classification Search ..... 439/660, 439/458, 459, 439–441, 680, 493
See application file for complete search history.

(56) References Cited

U.S. PATENT DOCUMENTS

| | | | | |
|---|---|---|---|---|
| 4,491,686 | A * | 1/1985 | Caviar | 174/87 |
| 5,324,213 | A * | 6/1994 | Frantz | 439/441 |
| 5,481,939 | A * | 1/1996 | Bernardini | 74/502.4 |
| 5,494,456 | A * | 2/1996 | Kozel et al. | 439/441 |
| 6,280,257 | B1 * | 8/2001 | North et al. | 439/680 |
| 6,454,596 | B1 * | 9/2002 | Montagano et al. | 439/493 |
| 6,702,593 | B1 * | 3/2004 | Ogawa | 439/79 |
| 6,793,537 | B1 * | 9/2004 | Stefaniu et al. | 439/660 |

* cited by examiner

*Primary Examiner*—Alexander Gilman
(74) *Attorney, Agent, or Firm*—Seyfarth Shaw LLP

(57) ABSTRACT

A canister assembly is provided including electrical connector having a plate which may be moved between a first and second position in order to lock a wire to the electrical connector. The electrical connector provides for a wire trap contact in order to quickly insert a conductor within the electrical connector through an end face of the electrical connector. The electrical connector includes flanges which allow it to be easily mounted to a canister and enclose an opening of the canister. The plate provides for a strain relief for the wires terminated by the electrical connector.

22 Claims, 5 Drawing Sheets

10
10

95
10
160
40
140
47a
42a
158
165
131
31a
82
167

27
37a
35
137
23
141
47a
90
20
22
120
140
81
39a
95
10
40
21
140
31a
131
135
42a
120
165
82
167

27
141
37a
137
151
152
145
23
47a
150
81
90
20
35
75
22
71
100
121

WIRETRAP ELECTRICAL CONNECTOR AND ASSEMBLY WITH STRAIN RELIEF PLATE

The present invention pertains to an electrical connector and assembly and in particular a wiretrap connector and assembly for terminating a wire and having a plate to provide a strain relief for the wire.

BACKGROUND

Electrical connectors are well known for connecting wires to printed circuit boards. For example, lighting fixtures generally require a ballast assembly to be incorporated in the fixture. The ballast includes a printed circuit board having electronic components that operate the ballast and have many wires extending from it, in order to connect to other parts of the fixture. Electrical connectors are known and may be used for the ballast. For example, a wiretrap connector is described in U.S. Pat. No. 5,494,456, which provides for an insulator housing having a plurality of holes formed by the insulator for receiving wires. Contacts are mounted within the insulator, each having a wire clamping electrical contact and an over-stress stop abutment for interacting with a wire which is inserted within the insulator of the electrical connector assembly. Such an electrical connector allows for the quick insertion of wires into the connector and provides for an overstress stop abutment for the contact. However, such electrical connectors are generally designed only for the vertical insertion of wires into the electrical connector. As well, such electrical connectors do not provide for a means of enclosing an opening provided by the ballast canister or electrically isolating the contact of the connector. Further, such electrical connectors do not provide for a strain relief for the wires terminated by the electrical connector.

Other means of connecting wires to a printed circuit board are known, such as direct soldering of the wires to the printed circuit board. Such a process is cumbersome due to the difficulties of processing the printed circuit board. Handling the printed circuit board for certain processing steps, such as testing or soldering in an oven is difficult because a plurality of long wires are attached to the printed circuit board during such operations. Therefore, there is desired an electrical connector and assembly which overcomes the above disadvantages.

SUMMARY OF THE INVENTION

In an embodiment, the present invention may provide an electrical connector comprising a housing having a front face and a rear face, the front face having a first hole, a plate attached to the front face, the plate having a second hole and the plate moveable between a first position where the first hole is aligned with the second hole and a second position where the second hole is off-set from the first hole and a contact mounted in the housing having a trap portion disposed adjacent the first hole and a mounting tail protruding from the bottom, wherein the first and second hole may receive a wire therethrough when the plate is in the first position and the wire is inserted to a mated position within the housing and engages the trap portion of the contact in order to provide an electrical connection between the wire and the contact and upon positioning the plate in the second position, the wire is distorted and locked in position within the housing in the mated condition.

In an embodiment, the rear face may have an open side and the contact has an enclosure portion that encloses the open side. In an embodiment, the mounting tail may extend from the enclosure portion. In an embodiment, the front face may include a first test hole and the plate may include a second test hole and when the plate is in the first position, the first and second test holes may be aligned so that a test probe may be inserted through the test holes to test the contact. In an embodiment, the front face may include a first test hole and the plate may include a second test hole and when the plate is in the second position, the first test hole is enclosed by the plate and the contact is electrically isolated from elements external to the housing.

In an embodiment, the housing may include a cavity in communication with the first hole so that insertion of the wire through the first hole may cause the wire to pass along an insertion path within the cavity and the trap portion of the contact may be disposed in the insertion path so that upon insertion, the wire may engage the trap portion and provide a frictional clamping connection between the contact and the wire. In an embodiment, the contact may be a generally P-shaped contact having an enclosure portion, a top portion formed at a right angle to the enclosure portion and a trap portion having an arcuate bend interconnecting the trap portion to the top portion and the trap portion angled at about 15–50° relative to the top portion. In an embodiment, the trap portion is adjacent a back-up wall provided by the housing upon which the conductor is positioned so that the conductor is clamped and trapped between the trap portion of the contact and the back-up wall. In an embodiment, the housing may include a flange formed at its perimeter for engaging a casing wall of a host device in order to mount the housing to the casing. In an embodiment, the flange may be formed at the sides of the front face and the casing may have an opening having at least two engaging sides so that the flange engages the engaging sides of the casing and the front face encloses the opening. In an embodiment, the plate may provide for a grommet for enclosing the opening of the casing.

In an embodiment, the plate may provide for a strain relief for the wire inserted therein. In an embodiment, the housing may include a lock member for locking the plate in one of the first and second positions. In an embodiment, the lock member may include a protrusion formed on the plate and a corresponding recess formed on the front face so that upon positioning of the plate from the first position to the second position, the protrusion engages the recess, locks the plate in the second position and the plate locks the wire in the mated condition. In an embodiment, the front face may include an actuator wall having a channel formed therein for receiving a rail of the plate so that the rail slides in the channel when the plate slides from the first to the second position.

In another embodiment, the present invention provides for an assembly for terminating a wire to a printed circuit board (PCB) comprising a PCB having electronic components and an electrical connector mounted thereto, the electrical connector including a housing have a front face oriented perpendicular to the PCB, a casing having an opening at an end and the PCB mounted within the casing so that the front face encloses the opening and a wire inserted through the front face of the electrical connector in a direction parallel to the PCB and the wire terminated by the electrical connector so that the wire is electrically connected to the PCB. In an embodiment, the PCB may have an edge and the electrical connector may be mounted so that the front face may extend beyond the edge of the PCB and the front face may include a flange along a side for engaging a side wall of the opening of the casing in order to slidably mount the electrical connector to the casing.

In an embodiment, the front face may have a first hole formed therein for receiving the wire and a cavity formed within the housing in communication with the hole and a contact mounted within the cavity for engaging a stripped portion of the wire inserted within the cavity. In an embodiment, the housing includes a plate slidably attached to the front face, the plate having a second hole corresponding to the first hole of the front face and the plate providing a strain relief for the terminating wire inserted through the first and second holes. In an embodiment, the front face may include at least two holes for receiving the wire therethrough and an extended portion having an attachment member for attaching the plate to the front face and a protrusion, the plate mounted to the front face by the attachment member and the plate having a stop abutment and an edge for receiving an operator's finger or a tool so that in the first position the stop abutment may abut the protrusion and maintain the plate in a first position and upon activation by an operator's finger or a tool against the edge, the plate is slid to a second position. In an embodiment, the case may include a cover enclosing the casing and potting material may be provided to fill the casing. In an embodiment, the electrical connector may include a contact having an enclosure portion that encloses the housing of the electrical connector and prevents potting material within the casing from entering the housing. In an embodiment, the front face may include at least two holes for receiving the wire therethrough.

In a further embodiment of the invention, a method of terminating a wire is provided comprising the steps of providing a printed circuit board (PCB), an electrical connector including a housing having a front face, a casing having an opening and a conductor, mounting the electrical connector to the PCB so that the front face is perpendicular to the PCB and extends beyond an edge of the PCB, mounting the PCB within the casing so that the front face of the electrical connector encloses the opening of the casing, inserting a conductor through the front face into the electrical connector in order to terminate the conductor and electrically connect the conductor through the electrical connector to the PCB and locking the conductor to the electrical connector by actuating a lock member of the electrical connector. In an embodiment, the method may further comprise the step of filling the casing with pitch. In an embodiment, the front face may include a slidable plate having a hole and a first and second position and sliding the plate from the first to the second position in order to lock the conductor within the hole. In an embodiment, the method may further comprise the step of mounting the connector to the PCB and inserting contact tails of the connector into holes of the PCB and soldering the contact tails within the holes.

BRIEF DESCRIPTION OF THE DRAWINGS

For the purpose of facilitating an understanding of the invention, there is illustrated in the accompanying drawings an embodiment thereof, from an inspection of which, when considered in connection with the following description, the invention, its construction and operation, and many of its advantages should be readily understood and appreciated.

DETAILED DESCRIPTION

Figures 1, 2:
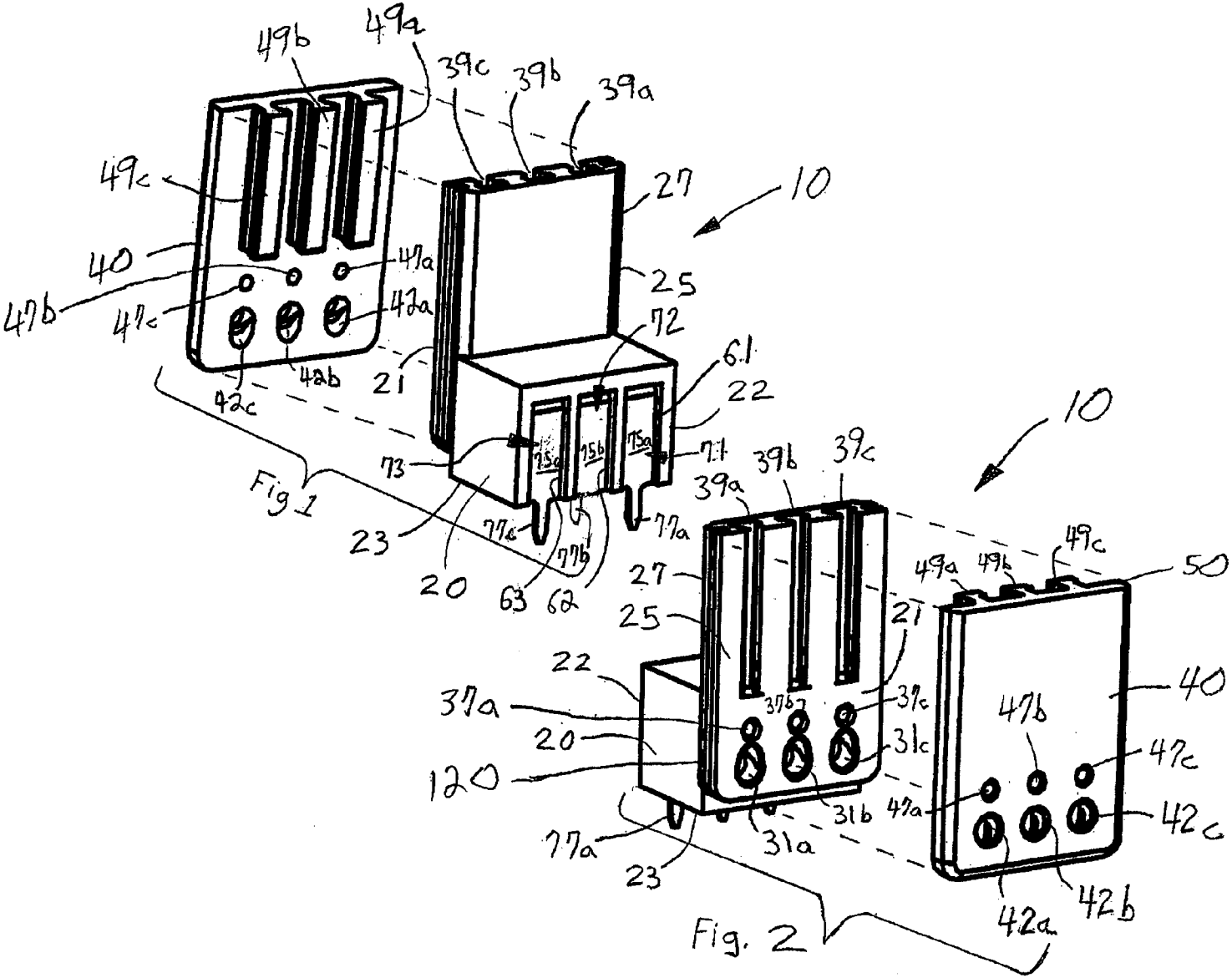
FIG. 1 is a perspective exploded view of the electrical connector of the present invention shown from a rear side.
FIG. 2 is a perspective exploded view of the electrical connector of FIG. 1 shown from the front side.

An embodiment of the present invention will be described with respect to FIGS. 1–6. Turning first to FIGS. 1 and 2, the electrical connector 10 is depicted including a housing 20 which includes a front face 21, rear face 22 and the bottom 23. In an embodiment, the housing is generally a cube-shaped box. The bottom 23 of the housing extends between the front face 21 and the rear face 22 and is generally perpendicular to the planes forming the front and rear faces 21, 22. In an embodiment, the housing 20 is formed of an insulator material such as a rigid polymer or plastic material, for example a glass filled PBT. In an embodiment, an actuator wall 25 forms the front face 21 of the connector 10. In an alternate embodiment, the front face 21 may be provided by the housing 20. The actuator wall 25 includes an extended portion 27 that extends beyond the housing 20 of the connector 10. In an embodiment, the actuator wall 25 is integrally molded with the housing 20. The front face 21 includes a plurality of holes 31*a*, 31*b*, 31*c* formed therethrough. The housing 20 includes a cavity 35 (see FIG. 5) and the holes 31*a*, 31*b*, and 31*c* are in communication with the cavity 35. The holes are formed for receiving a wire therein and are slightly larger than the wire inserted therein. In an embodiment where a wire of 18 gage solid wire is used a hole may have a diameter of 0.086 inches. Other gage wire may also be used in the holes 31*a, b, c*.

Also provided in the front face 21 are test holes 37*a*, 37*b*, 37*c*. The test holes 37*a*, 37*b*, 37*c* are provided to communicate with the cavity 35 and for receiving a test probe in order to test the circuit to be sure it is properly and electrically connected to a printed circuit board. As shown in FIG. 2, the front face includes three holes 31*a*, 31*b*, 31*c* and arranged above each hole is a corresponding test hole 37*a*, 37*b*, 37*c*. However, the present invention may have any number of holes formed in the front face 21 and, as well, the arrangement of the test holes 37*a*, 37*b*, 37*c* need not necessarily be corresponding in location to each of the holes 31*a*, 31*b* and 31*c*. It is preferred that the number of holes 31*a*, 31*b*, 31*c* and test holes 37*a*, 37*b*, 37*c* corresponds to the number of contacts provided within the housing, so that each contact may be tested via a test probe and wires may be terminated to each contact.

The front face 21 also includes actuation means such as channels 39*a*, 39*b*, 39*c*. Each connector 10 also includes a plate 40 (depicted in FIGS. 1 and 2 being unattached, so that the plate 40 and front face 21 may be viewed more fully) which includes holes 42*a*, 42*b* and 42*c* disposed on the plate that extend through the thickness of the plate 40. The plate includes test holes 47*a*, 47*b*, 47*c*. The plate 40 also includes rails 49*a*, 49*b*, 49*c* of the plate 40 which extend from a top edge 50 of the plate 40 and extend in a direction transverse to the edge 50. The holes 42*a*, 42*b*, 42*c*, test holes 47*a*, 47*b*, 47*c* and rails 49*a*, 49*b*, 49*c* of the plate 40 are formed to correspond in orientation to the holes 31*a*, 31*b*, 31*c*, test holes 37*a*, 37*b*, 37*c* and channels 39*a*, 39*b*, 39*c*, respectively, of the front face 21.

Figures 5, 6:
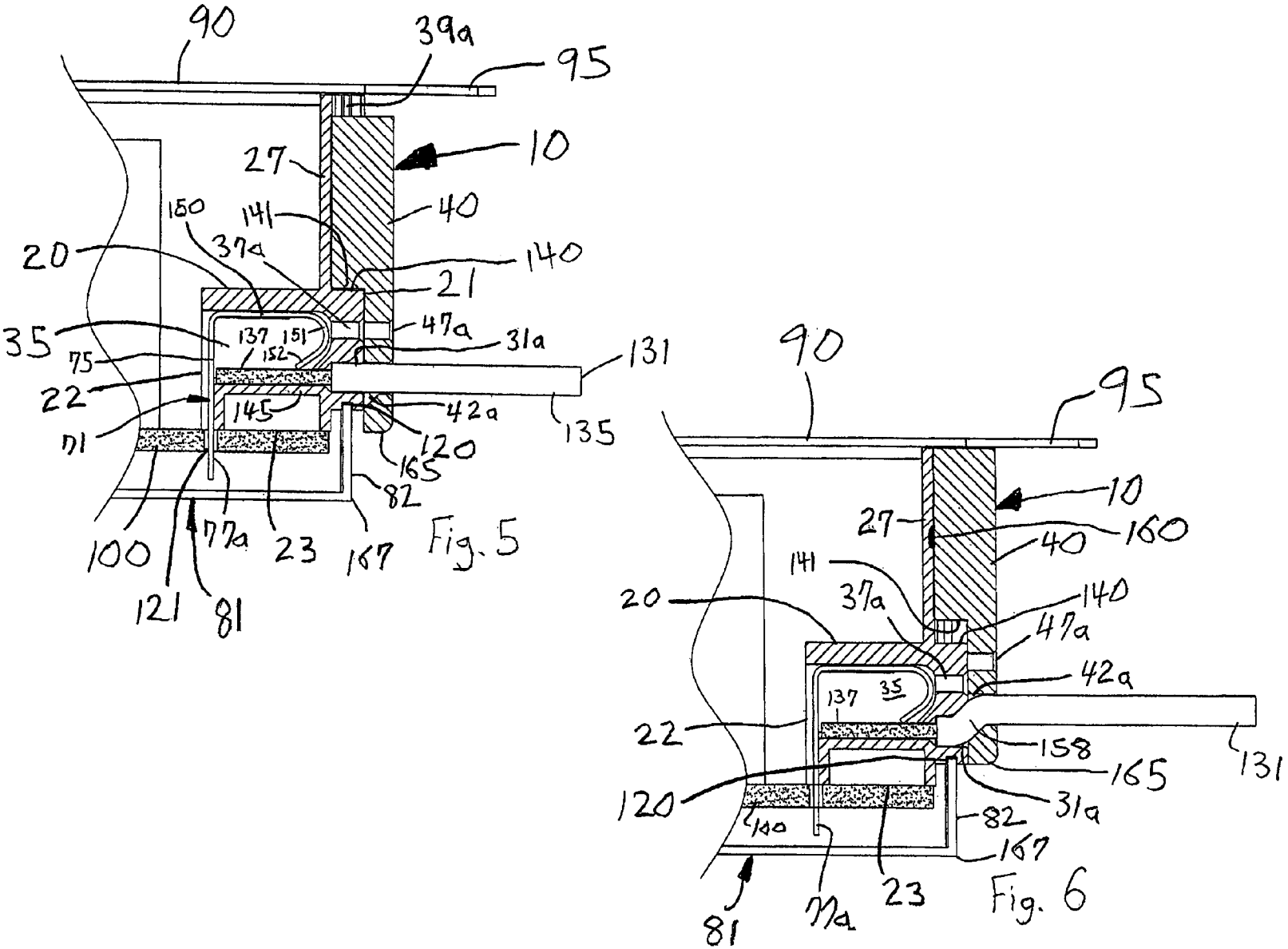
FIG. 5 is an enlarged section view taken at line 5—5 of FIG. 4 showing the electrical connector in a first position.
FIG. 6 is an enlarged view similar to FIG. 5 showing the electrical connector in a second position.

The plate 40 is mounted to the front face 21 by inserting the rails 49*a*, 49*b*, 49*c* within the corresponding channel 39*a*, 39*b*, 39*c*, respectively, and sliding the plate 40 downward along the extended portion 27 of the actuator wall 25. The plate 40 is fully mated to the front face 21 in a first position when the rails 49*a*, 49*b*, 49*c* are fully received within the channels 39*a*, 39*b*, 39*c*, respectively. The holes 42*a*, 42*b*, 42*c* and test holes 47*a*, 47*b*, 47*c* of the plate 40 will be aligned with the holes 31*a*, 31*b*, 31*c* and test holes 37*a*, 37*b*, 37*c* of the front face 21 in the first position. In an embodiment, the holes 42*a*, 42*b*, 42*c* of the plate 40 have the same diameter as the holes 31*a*, 31 *b*, 31*c* of the front face 21 and wires may be inserted through the holes 42*a*, 42*b*, 42*c* of the plate 40, into the holes 31*a*, 31*b*, 31*c* of the front face 21 and into the cavity 35 within the housing when the plate 40 is in the first position (as shown in FIG. 5).

It is also to be understood that in the first open position, when the plate 40 is slid fully downward onto the front face 21, the test holes 47 will be aligned with the test holes 37 on the front face so that a test probe may be inserted all the way through the test holes 47*a*, 47*b*, 47*c* and into the cavity 35 in order to test the contacts therein. It is to be understood that other actuator means may be provided in order to connect the plate 40 to the front face 21 and in order to provide movement of the plate 40 between a first and second position. For example, the channels 39 may be provided on the plate 40 and the rails 49 may be provided on the front face 21 of the actuator wall 25. As well, other means of attaching the plate 40 to the front face 21 may be provided including grooves, flanges, fasteners or pivot members.

The housing 20 includes open portions 61, 62, 63 at the rear face 22. The open portions 61, 62, 63 extend into the cavity 35 of the housing 20. In an embodiment, each open portion 61, 62, 63 is generally rectangular and is shaped to receive contacts 71, 72, 73 therein. Each contact includes an enclosure portion 75*a*, 75*b*, 75*c*. The enclosure portion 75*a*, 75*b*, 75*c* is a flat vertical portion of the contact which includes a mounting tail 77*a*, 77*b*, 77*c*. The enclosure portion 75 of the contact 71, 72, 73 is formed so that it encloses each of the open portions 61, 62, 63 at the rear face 22 of the housing 20. In an embodiment, the open portions 61, 62, 63 are formed so that each contact 71, 72, 73 may be mounted within the housing 20 through the open portions 61, 62, 63, respectively. Although each open portion 61, 62, 63 is a generally large opening, with respect to the overall surface area of the rear face 21, each of the openings 61, 62, 63 may be completely enclosed by each of the enclosure portions 75*a*, 75*b*, 75*c* of the contacts 71, 72, 73 respectively. Due to the flat long and broad nature of each of the enclosure portions 75*a*, 75*b*, 75*c* they can completely enclose each of the open portions 61, 62, 63, respectively.

Figure 3:
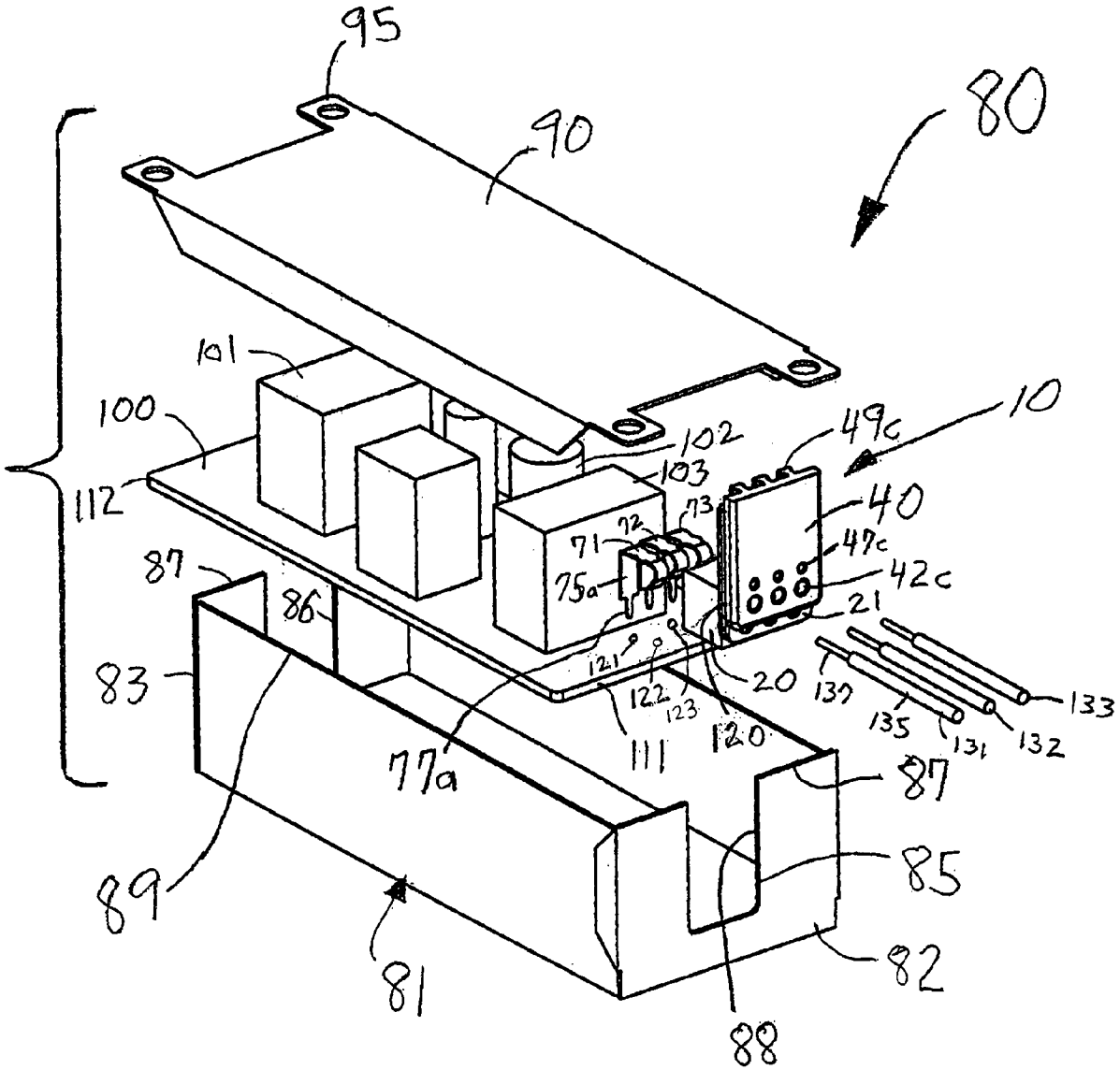
FIG. 3 is a perspective exploded view of an assembly of the present invention including the electrical connector of FIG. 1.

Turning to FIG. 3, a casing assembly 80 of the present invention will be described. A casing 81 is provided having a first end 82 and a second end 83. An opening 85, 86 is formed at each end 82, 83 respectively. In an embodiment, the opening 85, 86 is rectangular in shape and extends so that it has an open end at the top edge 87 of the first and second end 82, 83. The casing 81 includes a casing wall 88 that forms the opening 85. In an embodiment, the casing 81 is formed of a metallic material such as stamped aluminum. In an embodiment, the casing 81 is generally rectangular shaped having five sides and an open top 89. A lid 90 is formed, in an embodiment, as a generally flat rectangular sheet that may be placed over the top 89 of the casing 81. The lid 90 may include flanges 95 so that the assembled casing 80 may be mounted to a host device, such as a lighting fixture.

A printed circuit board (PCB) 100 is provided having electronic components 101, 102, 103 such as capacitors, resistors or microprocessors mounted thereon. In an embodiment, the printed circuit board 100 is generally rectangular in shape and includes a first edge 111 and a second edge 112. The connector 10 is mounted to the printed circuit board 100 so that the end face 21 extends beyond the first edge 111. In an embodiment, a second electrical connector (not shown) may also be mounted so that it extends beyond the second edge 112 on the PCB 100.

Mounting of the connector 10 to the PCB 100 will now be described in more detail. As shown in FIG. 3, the contacts 71, 72, 73 are oriented above mounting holes 121, 122, 123. Although FIG. 3 depicts the contact 71, 72, 73 separated from the housing 20 of the connector 10, this drawing is depicted in this way only as a convenience to depict how the contacts 71, 72, 73 are mounted to the PCB 100. However, in a preferred embodiment, the contacts 71, 72, 73 will first be mounted within the housing 20 by known mounting methods, so that mounting tails 77*a*, 77*b*, 77*c* extend perpendicularly from the bottom 23 of the housing. In an embodiment, the mounting tail 77*b* is offset with respect to mounting tails 77*a*, 77*e* to allow for arc tracking in a high density configuration (See FIG. 2).

The entire electrical connector 10 is then mounted to the PCB 100 by inserting contact tails 77*a*, 77*b*, 77*c* into the corresponding mounting holes 121, 122, 123, respectively. In an embodiment, the mounting holes 121, 122, 123 are soldered in thru-holes. After mounting of the electrical connector 10 to the PCB 100; and mounting of the other components 101, 102, 103 to the PCB 100, the PCB assembly may then be processed by running the PCB thru a solder wave to flow the solder within holes 121, 122, 123 and other thru-holes on the PCB 100. Such processing retains the electrical connector 10 and other components 101, 102, 103 on the PCB 100. After running the PCB 100 through the solder wave, the solder is allowed to cure so that the mounting tails 77*a*, 77*b*, 77*c* will be securely mounted and electrically connected through the soldered thru-holes 121, 122, 123. After such processing of the PCB 100 and its components, the PCB 100 is then mounted within the casing 81 as described above.

The electrical connector 10 includes a flange 120 formed at an outer edge of the front face 21. The flange 120 is formed so that it engages the casing wall 88 of the opening 85 formed at the first end 82 of the casing 81. Thus, it may be understood that after the connector 10 is mounted to the PCB 100, the entire PCB assembly can be mounted within the casing 81 so that the flange 120 of the connector 10 mates with the casing wall 88 of the opening 85 and the end face 21 is slid down into the opening 85 and encloses the opening.

Figure 4:
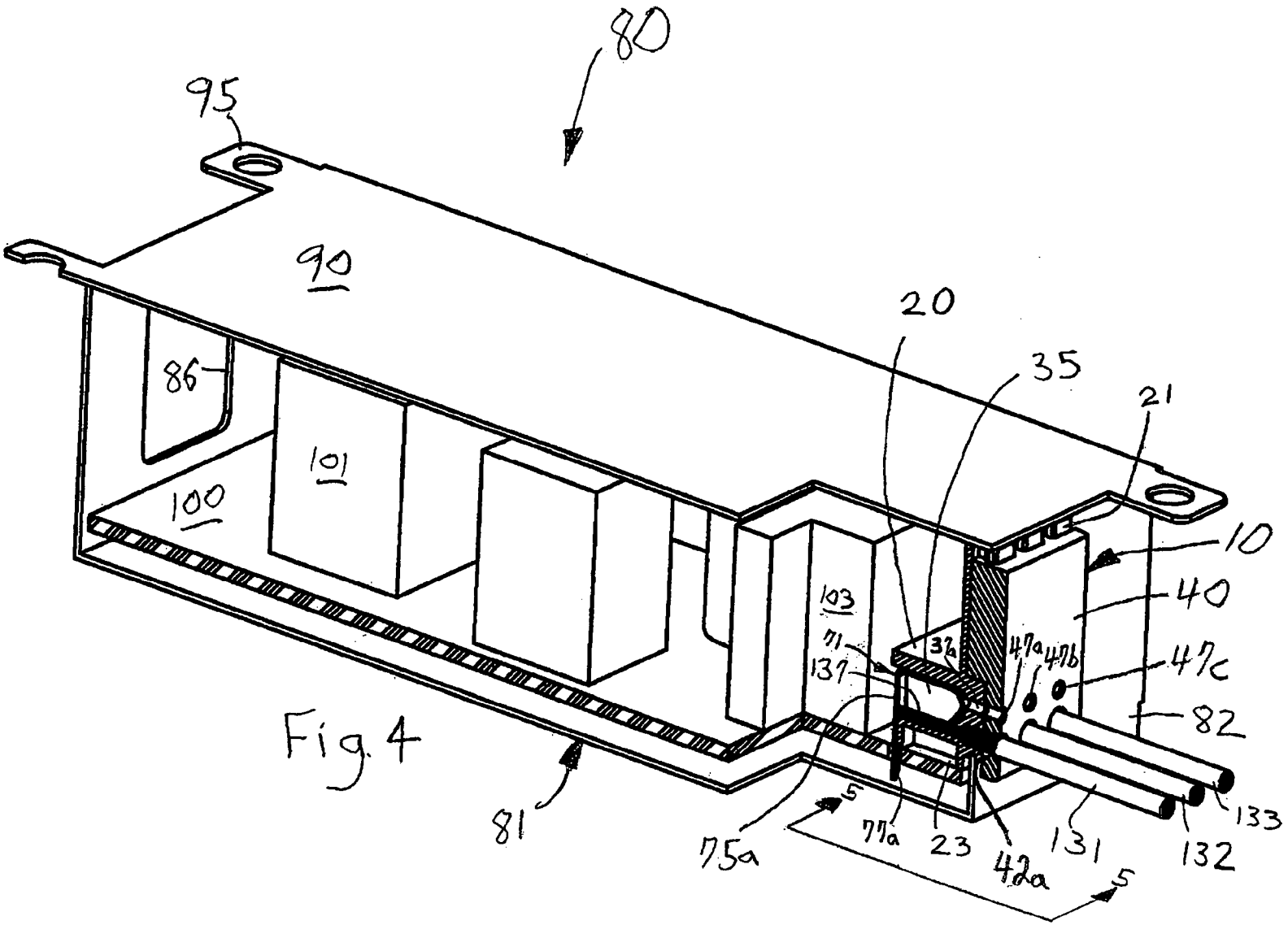
FIG. 4 is a perspective partially cut away view of the assembly of FIG. 3.

The completed casing assembly 80 is depicted in FIG. 4. The casing assembly 80 has been partially sectioned, so that the electrical connector 19 may be described in more detail. FIG. 5 is an enlarged view of the sectioned area 5—5 taken from FIG. 4. The operation of the electrical connector 10 mounted to the PCB 100 will be described with respect to FIGS. 4 and 5. In the completed casing assembly 80, the edges of the face 21 of the connector 10 act as a grommet which encloses the opening 85 at the first end 82 of the casing 81. The plate 40 includes holes 42*a*, 42*b*, 42*c* disposed therein for receiving wires 131, 132, 133. Prior to insertion and termination of the wires 131, 132, 133 the connector 10 may be tested.

As shown in FIG. 5, the plate 40 is in a first position where the plate has been slid downward so that the holes 31*a*, 31*b*, 31*c* and test holes 37*a*, 37*b*, 37*c* of the front face 21 are aligned with the holes 42*a*, 42*b*, 42*c* and test holes 47*a*, 47*b*, 47*c* of the plate, respectively. The housing includes a protrusion 140 and the plate 40 includes a stop abutment 141 so that when the plate 40 is in the first position, as shown in FIG. 5, the stop abutment 141 will abut against the protrusion 140 and a locking member will maintain the plate 40 in the first position. In the first position, prior to insertion of the wires 131, 132, 133, the connector 10 may be tested by inserting a test probe (not shown) through the test holes 37*a*, 47*a* which are aligned (as shown in FIG. 5). The test probe is inserted so that it extends into the cavity 35 within the housing 20.

As shown in FIG. 5, the contact 71 has generally a P-shape including enclosure portion 75, a top portion 150, an arcuate bend 151 and a trap portion 152. In an embodiment, the top portion 150 is bent at a right angle relative to the enclosure portion 75. In an embodiment, the trap portion 152 is angled at about 15–50° relative to the top portion 150. In an embodiment, the contact 71 is disposed so that the arcuate portion 151 is adjacent the test hole 37*a* so that when a test probe is inserted through the test holes 37*a*, 47*a*, the probe will abut against the arcuate portion 151. A proper electrical connection through the contact tail 77*a* to the printed circuit board 100 is tested. As discussed above, a corresponding test hole 37*a*, 37*b*, 37*c* is provided for each contact 72, 73, respectively. The test probe may be moved to each hole 37*b*, 37*c* in order to test each of the contacts 71, 72, 73 populated within the connector 10. In the embodiment depicted, the test holes 37, 47 may only be used when the plate is in the first position. It is to be understood that, while only three contacts are depicted in the figures of this application, any number of contacts may be provided for other types of applications. Likewise, as the number of contacts 71, 72, 73 is varied, the number of holes 31, 42 and test holes 37, 47 will also vary accordingly.

After testing of the electrically connector 10 potting material may be provided within the interior of the casing 81. The pitch may completely fill the interior of the casing 80. As discussed above, the enclosure portion 75 of the contacts 71, 72, 73 encloses the rear face 22 of the housing 20 so that pitch will not seep into the cavity 35 of the electrical connector 10.

Once the electrical connector 10 has been tested, determined to work properly and potted, the assembled canister 80 may then be mounted to a host device. For example, the canister assembly 80 may provide for a ballast for a lighting fixture. The completed assembly 80 may be attached to the host device, such as a lighting fixture and then sent into the field where it will be assembled to a building. Thus, it is understood that the electrical connector 10 provides for a finished part of the assembly 80 and the plate 40 appears as a grommet which encloses the end of the casing 81 and provides for a integrated and finished look for the casing assembly 80.

Following assembly of the casing 80 to the host device the wires 131, 132, 133 may then be terminated to the device 81 via the electrical connector 10. Alternatively, the wires 131, 132, 133 may be terminated to the device prior to assembly of the device to the ballast. In an embodiment, each wire has an insulator jacket 135 and a stripped bare conductor end 137. In an embodiment, each stripped conductor 137 has a length at least as long as the width of the cavity 35 of the housing 20. With the plate 40 in the first position the wires 131, 132, 133 may be inserted through the holes 42*a*, 42*b*, 42*c*, respectively. The stripped conductor 137 of the wire 131, as shown in FIG. 5, is received within the cavity 35. The connector 10 is mounted so that trap portion 152 of the contact 71 is disposed along an insertion path provided in communication with the hole 31*a*, so that upon insertion of the wire 131, the stripped conductor 137 will enter along the insertion path and engage the trap portion 152 of the contact 71. Insertion of the conductor 137 of the wire 131 causes the trap portion 152 to deflect and bend upwardly toward the top portion 150 of the contact. Upon deflection and biasing-back, the trap portion 152 causes the sharp tip of the trap portion 152 penetrates the outer surface of the stripped conductor 137 in order to make an electrical contact thereto and to trap the conductor so that the wire 131 is resistant to backing-out through the hole 42. In an embodiment, the contact 71 is formed of such metallic material such as 0.014 inch thick pre-plated copperstock so that the trap portion 152 maintains a bias against the stripped conductor 137 and causes the trap portion 152 to clamp against and trap the conductor 137.

A backup wall 145 is provided by the housing 20 adjacent the insertion path, in order to hold the stripped conductor 137 in position against the compression force of the trap portion 152 of the contact 71. Thus it is understood that the shape of the contact 71 provides for the trap portion 152 to make an electrical connection with the conductor 137 and simultaneously trap the conductor 137 within the cavity 35 of the housing 20. While the force of the trap portion 152 is sufficient to maintain the wire 131 within the cavity 35, during normal movement of the casing assembly 80 and to withstand vibrational forces, if the wire 131 were directly pulled-on, the conductor 137 could be removed from the cavity 35 when the plate 40 is in the open or first position (FIG. 5).

In order to lock the conductor 131 within the housing 20 the plate 40 is moved from the first position to a second position as shown in FIG. 6. The plate 40 is slid upwardly so that the holes 42*a*, 42*b*, 42*c* are offset with respect to the holes 31*a*, 31*b*, 31*c*, respectively, and causes the wire 131 to have a distorted portion 158 providing a generally serpentine shape to the conductor 137. The plate 40 is locked in the second position by a locking member 160. In an embodiment, the locking member may be a protrusion formed on the back of the plate 40 which mates with a recess formed in the front face 21 of the extended portion 27 of the housing 20. Other locking members may be provided such as fasteners, detents, buttons or slide members. In an embodiment, the offset between the first and second positions provides for a vertical offset in the range of 0.050 to 0.150 inches between the longitudinal axis of the conductor 137 and the longitudinal axis of the wire 131 in the distorted second position. It is to be understood that flexure or rotation of the wire 131 will not be transmitted to the conductor 137 due to the locked position of the plate 40 acting as a strain relief.

In an embodiment, the plate 40 is oriented so that its edge 165 is spaced apart from the bottom 167 of the casing 81 at the first end 82, so that an operator's fingers or a tool may be placed under the edge 165 in order to slide the plate 40 upwardly into the second position. Other sliding means may be provided such as a tool notch, finger grips or serrated portions provided on the plate 40 in order to help slide the plate 40 into the second position. The plate 40 in the second position provides for a locking means in order to lock the wire 131 within the connector 10. The distortion of the conductor, in an embodiment, occurs by moving the plate approximately 0.100 inches which provides a sufficient strain relief to the wire 131, so that if the wire is pulled-on with a force of up to 25 pounds, the plate 40 will prevent the conductor 137 from being removed from the cavity 35. Therefore, it is understood that the canister assembly 80 of the present invention provides for a simple and quick method of terminating a wire 131 to a connector 10 and locking the conductor thereto. The connector 10 also provides for an integrated system including a grommet formed by the plate 40 and end face 21 which seals the opening 85 of the canister 81. The flange 120 is provided around three sides of the end face 21 so that the side walls 88 of the opening 85 can be mated to the flange in order to quickly mount the connector 10 to the canister 81.

Figure 7:
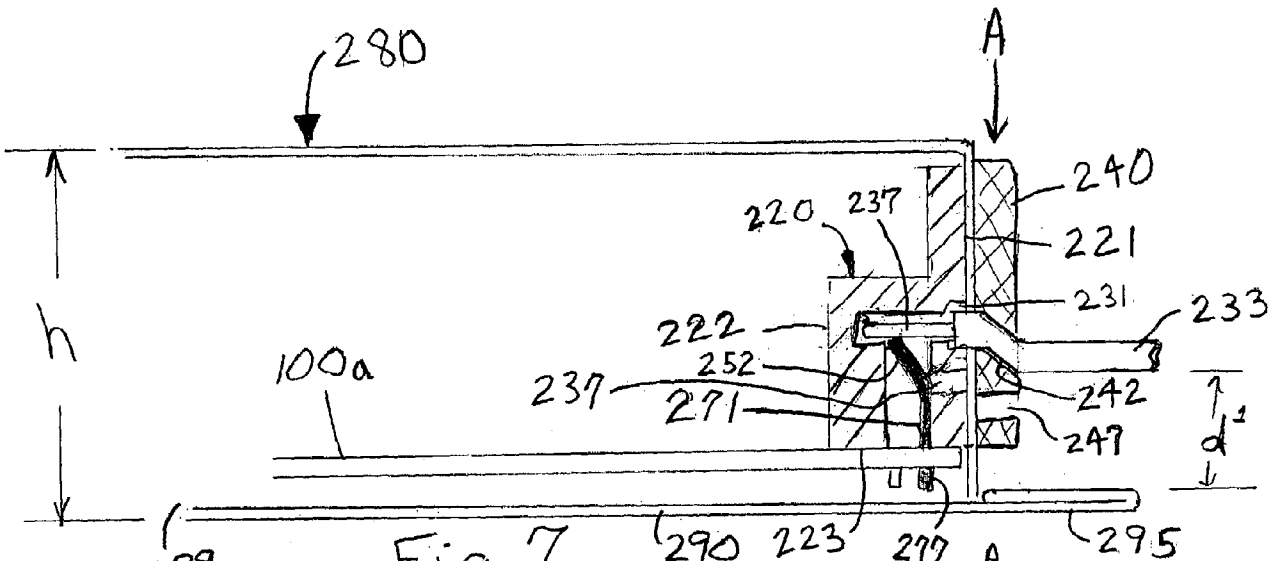
FIG. 7 is a section view similar to FIG. 5 of an alternate embodiment of the present invention.

A further embodiment of the present invention is depicted with respect to FIG. 7. An electrical connector housing 220 is shown having a front face 221, a rear face 222 and a bottom 223. A first hole 231 is formed through the front face 221 and receives a stripped conductor 237 therein which extends from a wire 233. A plate 240 is slidably mounted to the front face 221. The plate 240 includes a second hole 242 for receiving the wire 233. FIG. 7 shows the plate 240 slid in to its second, offset or closed position in the direction as shown by the arrow A. As shown in FIG. 7, the wire 233 is distorted and provides for a strain relief when the plate 240 is in the second position. As described thus far, the invention of FIG. 7 is similar to the invention described previously with respect to FIGS. 1–6.

However, with respect to the orientation of the electrical connector 220 within the casing assembly 280, the electrical connector 220 is inverted, compared to the casing assembly 80, described above with respect to FIGS. 3–6. The casing assembly 280 provides for a five-sided oblong box having an open side 289. A lid 290 is placed on the casing assembly 280 and encloses the open side 289. While the casing assembly 80 depicted in FIGS. 3–6, provided for the lid 90 to be placed on the "top" for the invention depicted in FIG. 7 the lid 290 may be viewed as being located at the "bottom." (The use of the terms "top" and "bottom" is relative, in that such terms are used only to describe the orientation of the casing assembly as shown in the drawing figures provided herein. However, it is to be understood that when the casing assembly of the present invention is used in the field and installed in a host device, such as a lighting fixture, the casing assembly may be rotated so that the "top" becomes the "bottom," or the "bottom" becomes the "top." In further applications the "top" or "bottom" may become a "side.")

As shown in FIG. 7, the printed circuit board 100*a* is oriented adjacent the lid 290 when the casing assembly 280 and electrical connector 220 are is assembled together. Therefore, in comparison to the casing assembly 80, described above with respect to FIGS. 3–6, the printed circuit board 100*a* of FIG. 7 is on the opposite side of the casing assembly 280. In view of the inversion of the assembly 280 of FIG. 7, in comparison to the casing assembly 80 of FIGS. 3–6, a further embodiment of the present invention is provided by modifying the electrical connector 220 to accommodate the inverted orientation within the casing assembly 280.

Thus, the contact 271 includes a trap portion 252 which abuts against the conductor 237 from an opposite side of the conductor 237 from that shown for the conductor 137 of FIGS. 1–6. In the embodiment shown in FIG. 7, the contact 271 extends linearly downward and includes a co-linear contact tail 277. When the connector 220 is mounted to the PCB 100*a*, the contact tail 272 extends through the PCB 100*a*. The trap portion 252 of the contact is of a generally linear shape and is angled from the contact body 271 at an angle of between 15 and 45 degrees from the longitudinal access of the contact body 271. The contact 271 may be loaded into the housing of the electrical connector 220 via any means well known in the art. The trap portion 252 operates similar to that described above for FIGS. 1–6, so that when the stripped conductor 237 is inserted within the first hole 231, it abuts against the tip of the trap portion 152 and causes the trap portion 152 to move away from the conductor 237 and to bias back against the conductor 237 in order to clamp the conductor within the housing of the electrical connector 220.

The electrical connector 220 also includes a first test hole 237 which is oriented adjacent the first hole 231 and is in communication with the contact body 271. The plate 240 includes a second test hole 247. When the plate 240 is in its first or unlocked position (not shown in FIG. 7) the first test hole 237 and second test hole 247 will be aligned so that a probe can be inserted through both holes 237, 247 in order to engage the contact body 271. The probe can provide for testing to determine that a proper electrical circuit has been established. As shown in FIG. 7, upon sliding of the plate 240 in direction of arrow A, the second test hole 247 is offset, moves out of alignment with the first test hole 237 and provides for a closed system in order to seal the contact 271 from the external environment.

In an embodiment, the electrical connector 220 is formed so that the first hole 231 and second hole 242 are separated a predetermined distance from the bottom 223 of the electrical connector 220. When the connector 220 is mounted to the casing assembly 280, there is sufficient room between the wire 233 extending from the first hole 231 and the flange 295 extending from the lid 290, so that a fastener extending through the flange 295 may be adjusted in order to attach the casing assembly 280 to a fixture. As shown, a distance $d^1$ is provided between the insulator of the wire 233 and the flange 295, which provides for adequate access by a tool in order to access a fastener mounted on the flange 295. In an embodiment, the distance $d^1$ is approximately 0.40 inches. Thus, it can be understood, that even when the plate 240 is slid to its closed position, as shown in FIG. 7, and the wire 230 is crimped downward towards the lid 290, there is still be a gap $d^1$ provided. In an embodiment, the total height h of the casing assembly 280 may be approximately 1.16 inches.

Figure 8:
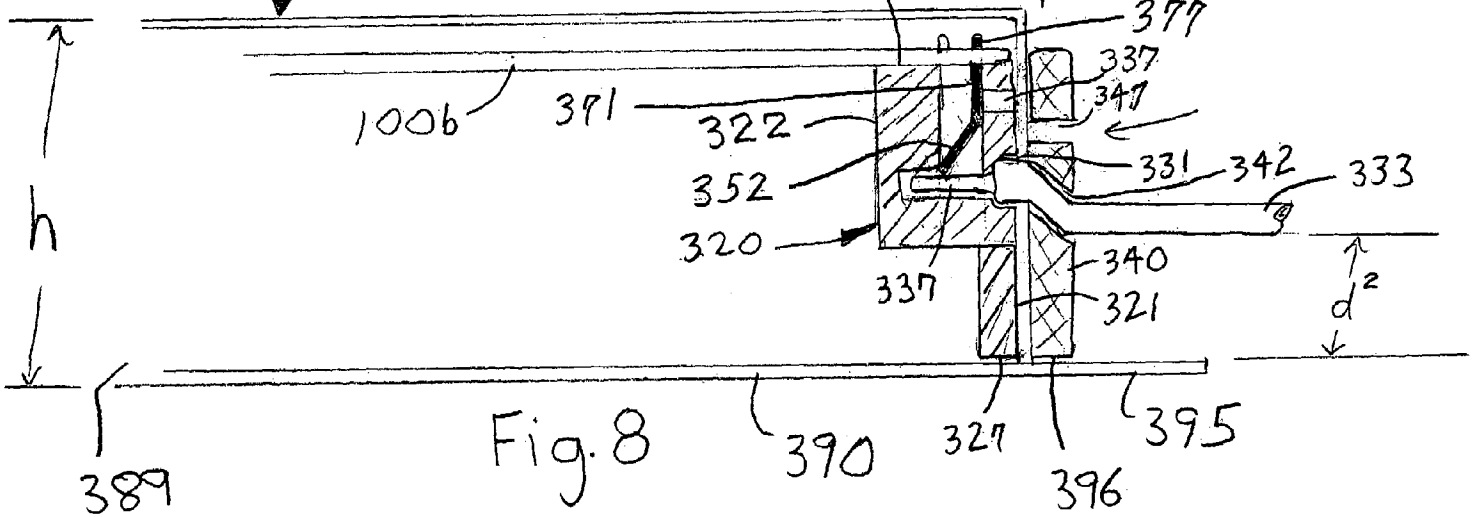
FIG. 8 is a section view of similar to FIG. 5 of a further alternate embodiment of the present invention.

Turning to FIG. 8 a further alternate embodiment of the present invention is provided. An electrical connector 320 is shown that is similar to the electrical connector 220 described above with respect to FIG. 7, except that it is inverted from the orientation shown in FIG. 7. The electrical connector 320 of FIG. 8 includes a front face 321, a rear face 322 and a bottom 323. A first hole 331 is provided protruding through the front face 321 and receives a stripped conductor 337 therein. A plate 340 is slidably mounted onto the front face 321 and includes a second hole 342 for receiving a wire 333 therein. As shown in FIG. 8, the plate 340 is in its closed or second position having been slid in the direction of arrow A in order to crimp the wire 333 within the first and second holes 331, 342.

As shown in FIGS. 7 and 8, the second holes 242, 342, respectively, are angled with respect to the longitudinal access of the conductor 237, 337. The angled second hole 242, 342 allows for the insulator of the wire 233, 333 to be distorted. However, in an alternate embodiment, the second hole 242, 342 may be collinear with the first hole 231, 331 and the longitudinal access of the conductor 237, 337, respectively.

FIG. 8 depicts a casing assembly 380 having an inverted orientation from the assembly 280 shown in FIG. 7. The lid 390 of FIG. 8 is shown at the "bottom," similar to that shown in FIG. 7; however, the printed circuit board 100*b* is on the opposite side, away from the open side 389 of the casing assembly 380. In view of such an orientation, when the plate 340 is slid to its closed or second position, as shown in FIG. 8, the end 396 will abut against the lid 390, adjacent the flange 395.

Similar to the distance $d^1$ discussed above, a spacing distance $d^2$ must be maintained between the lid 390 and the wire 333, so that a fastener provided on the flange 395 may be accessed and adjusted. However, as may be understood, due to the inverted orientation of the electrical connector 320 of FIG. 8 (with respect to FIG. 7), the distance $d^2$ is measured differently. Distance $d^2$ is generally the distance between the first hole and second hole 337, 342, respectively, and the extended portion 327 and end 396 of the plate 340 (whereas, in FIG. 7 the distance $d^1$ was with respect to the first and second holes 231, 242 and the bottom 223 of the electrical connector 220). However, it is preferable that distance $d^2$ also is equal to approximately 0.40 inches. In an embodiment, in order to allow for uniform tooling and machinery to be employed to manufacture a hermaphroditic housing for either the electrical connector 220 of FIG. 7 or the electrical connector 320 of FIG. 8, the location of the first hole 331, 231 should be centered along the housing of the electrical connector 220, 320, so that the dimension $d^1$ equals dimension $d^2$, as shown in FIG. 7 and FIG. 8.

The connector housing 320 includes a first test hole 337 which is in communication with the electrical connector body 371. The plate 340 also includes a second test hole 347 which may be aligned with the first test hole in order to allow a probe to be inserted therein in order to test the contact 371. As shown in FIG. 8, the second test hole 347 is offset with respect to the first test hole 337 when the plate 340 is moved to its locked or closed position.

As shown in FIG. 8, the test hole 337 lies adjacent the contact body 371 away from the trap portion 352. It may be understood that the contact body 371 may be held securely within the housing, as that portion of the contact does not need to flex. By providing for the orientation of the contact hole 337 adjacent the contact body 371, the insertion of a probe is less likely to damage or permanently deform the contact and prevents a probe from engaging the trap portion 352 of the contact, which may permanently deform the trap portion so that it does not properly flex or bias against a conductor 337 to be inserted within the electrical connector 320.

The contact 371 of the electrical connector 320 operates in a similar fashion as discussed above with respect to the contact 271 of FIG. 7. The contact 371 includes a trap portion 352 which clamps against the stripped conductor 337 when inserted into the connector housing 320. The contact 371 includes a mounting tail 377 which is inserted through the PCB 100*b* when the electrical connector 320 is mounted thereto.

Therefore, it may be understood that an electrical connector is provided by the present invention which provides for the quick and easy termination of a wire through an opening of a casing assembly and the electrical connector provides for strain relief on the wire via a slidable plate. Such functionality may be provided by the electrical connector for many types of casing assemblies, such as those having a PCB mounted at an open side or PCB adjacent a lid. As well, it may be understood that multiple types of contacts may be provided with the electrical connector, in order to provide a clamping function to help retain the conductor within the electrical connector housing and provide an electrical connection thereto. The present invention allows for the assembly of a casing assembly to be completed without having to attach wires thereto until the final assembly steps in the field. The present invention also enables the wires to be inserted quickly, but after closing of the plate or actuator the wires may be held strongly therein and are bent in a way to prevent the wires from screwing out or e.g. being rotated so that they thread.

While particular embodiments of the present application have been shown and described, it will be apparent to those skilled in the art that changes and modifications may be made without departing from the principles of the present application in its broader aspects. Therefore, the aim in the appended claims is to cover all such changes and modifications as fall within the true spirit and scope of the present applications. The matters set forth in the foregoing description and accompanying drawings is offered by way of illustration only and not as a limitation. The actual scope of the present application is intended to be defined in the following claims when viewed in their proper perspective based on the prior art.

What is claimed is:

1. An electrical connector comprising:

a housing having a front face and a rear face, the front face having a first hole;

a plate slidably attached to the front face, the plate having a second hole and the plate moveable between a first position where the first hole is aligned with the second hole and a second position where the second hole is linearly off-set from the first hole; and a contact mounted in the housing having a trap portion disposed adjacent the first hole wherein the first and second hole may receive a wire therethrough when the plate is in the first position and the wire is inserted to a mated position within the housing and engages the trap portion of the contact in order to provide an electrical connection between the wire and the contact and upon sliding the plate linearly along the front face to the second position, the wire is distorted and locked in position within the housing in the mated condition.

2. The electrical connector of claim 1 wherein the front face includes a first test hole and the plate includes a second test hole and when the plate is in the first position the first and second test holes are aligned so that a test probe may be inserted through the test holes to test the contact.

3. The electrical connector of claim 1 wherein the front face includes a first test hole and the plate includes a second test hole and when the plate is in the second position, the first test hole is enclosed by the plate and electrically isolated from elements external to the housing.

4. The electrical connector of claim 1 wherein the front face provides for a strain relief for the wire inserted therein.

5. The electrical connector of claim 1 wherein the front face includes an actuator wall having a channel formed therein for receiving a rail of the plate so that the rail slides in the channel when the plate slides from the first to the second position.

6. The electrical connector of claim 1 wherein the housing includes a cavity in communication with the first hole so that insertion of the wire through the first hole causes the wire to pass along an insertion path within the cavity and the trap portion of the contact is disposed in the insertion path so that upon insertion the wire engages the trap portion and traps the wire.

7. The electrical connector of claim 6 wherein the contact is generally P-shaped having an enclosure portion, a top portion formed at a right angle to enclosure portion and a trap portion having an arcuate bend interconnecting the trap portion to the top portion and the trap portion angled at about 15–50° relative to the top portion and adjacent a back-up wall of the housing.

8. The electrical connector of claim 1 wherein the housing includes a lock member for locking the plate in one of the first and second positions.

9. The electrical connector of claim 8 wherein the lock member includes a protrusion formed on the plate and a corresponding recess formed on the front face so that upon positioning of the plate from the first position to the second position the protrusion engages the recess, locks the plate in the second position and the plate locks the wire in the mated condition.

10. The electrical connector of claim 1 wherein the housing includes a flange formed at its perimeter for engaging a casing wall of a host device in order to mount the housing to the casing.

11. The electrical connector of claim 10 wherein the flange is formed at the sides of the front face and the casing has an opening having at least two engaging sides so that the flange engages the engaging sides of the casing and the front face encloses the opening.

12. The electrical connector of claim 11 wherein the sides provide for a grommet for enclosing the opening of the casing.

13. An assembly for terminating a conductor to a printed circuit board (PCB) comprising:

a PCB having electronic components and an electrical connector mounted thereto;

the electrical connector including a housing having a front face oriented perpendicular to the PCB, the face having a linear actuator;

a casing having an opening at an end and the PCB mounted within the casing so that the front face encloses the opening; and a wire inserted through the front face of the electrical connector in a direction parallel to the PCB, the wire terminated by the electrical connector so that the wire is electrically connected to the PCB and actuation of the actuator causes the wire to be off-set and provide a strain relief.

14. The assembly of claim 13 wherein the PCB has an edge and the electrical connector is mounted so that the front face extends beyond the edge of the PCB and the front face includes a flange along a side for engaging a side wall of the opening of the casing in order to slidably mount the electrical connector to the casing.

15. The assembly of claim 13 wherein the casing includes a cover enclosing the casing and potting material filling the casing.

16. The assembly of claim 13 wherein the front face has a first hole formed therein for receiving the wire and a cavity formed within the housing in communication with the hole and a contact mounted within the cavity for engaging a conductor end of the wire inserted within the cavity.

17. The assembly of claim 16 wherein the housing includes a plate slidably attached to the front face, the plate having a second hole corresponding to the first hole of the front face in a first position and the plate providing a strain relief for the terminated wire inserted through the first and second holes when the plate is actuated to a second position.

18. The assembly of claim 17 wherein the front face includes at least two holes for receiving the wire therethrough and an extended portion having an attachment member for attaching the plate to the front face and a protrusion, the plate mounted to the front face by the attachment member and the actuator and the plate having a stop abutment and an edge so that upon activation against the edge in the first position the stop abutment abuts the protrusion and maintains the plate in the first position and upon activation by an operator's finger against the edge, the plate is slid to the second position.

19. The assembly of claim 18 wherein the electrical connector includes a contact having an enclosure portion that encloses the housing of the electrical connector and prevents potting material within the casing from entering the housing.

20. A method of terminating a conductor comprising the steps of:

providing a printed circuit board (PCB), an electrical connector including a housing having a front face with a linearly slidable plate and a casing having an opening;

mounting the electrical connector to the PCB so that the front face is perpendicular to the PCB and extends beyond an edge of the PCB;

mounting the PCB within the casing so that the front face of the electrical connector encloses the opening of the casing;

inserting a conductor through the front face into the electrical connector in order to terminate the conductor and electrically connect the conductor through the electrical connector to the PCB;

sliding the plate linearly along the front face of the housing; and locking the conductor to the electrical connector by actuating the plate.

21. An electrical connector comprising:

a housing having a front face and a rear face, the front face having a first hole;

a plate attached to the front face, the plate having a second hole and the plate moveable between a first position where the first hole is aligned with the second hole and a second position where the second hole is off-set from the first hole and the front face includes an actuator wall having a channel formed therein for receiving a rail of the plate so that the rail slides in the channel when the plate slides from the first to the second position; and a contact mounted in the housing having a trap portion disposed adjacent the first hole wherein the first and second hole may receive a wire therethrough when the plate is in the first position and the wire is inserted to a mated position within the housing and engages the tap portion of the contact in order to provide an electrical connection between the wire and the contact and upon positioning the plate to the second position, the wire is distorted and locked in position within the housing in the mated condition.

22. An assembly for terminating a conductor to a printed circuit board (PCB) comprising:

a PCB having electronic components and an electrical connector mounted thereto;

the electrical connector including a housing having a front face oriented perpendicular to the PCB;

a casing having an opening at an end and the PCB mounted within the casing so that the front face encloses the opening; and a wire inserted through the font face of the electrical connector in a direction parallel to the PCB and the wire terminated by the electrical connector so that the wire is electrically connected to the PCB;

the front face has a first hole formed therein for receiving the wire and a cavity formed within the housing in communication with the hole and a contact mounted within the cavity for engaging a conductor end of the wire inserted within the cavity;

the housing includes a plate slidably attached to the front face, the plate having a second hole corresponding to the first hole of the front face in a first position and the plate providing a strain relief for the terminated wire inserted through the first and second holes when the plate is in a second position; and the front face includes at least two holes for receiving the wire therethrough and an extended portion having an attachment member for attaching the plate to the front face and a protrusion, the plate mounted to the front face by the attachment member and the plate having a stop abutment and an edge so that upon activation against the edge in the first position the stop abutment abuts the protrusion and maintains the plate in the first position and upon activation by an operator's finger or tool against the edge, the plate is slid to the second position.

* * * * *